US005214918A

United States Patent [19]

Oguni et al.

[11] Patent Number: 5,214,918

[45] Date of Patent: Jun. 1, 1993

[54] REFRIGERATOR AND METHOD FOR INDICATING REFRIGERANT AMOUNT

[75] Inventors: Kensaku Oguni, Shimizu; Susumu Nakayama, Shizuoka; Hiromu Yasuda, Shizuoka; Rumi Minakata, Shizuoka; Kazumoto Urata, Shizuoka; Masatoshi Muramatsu, Shimizu; Takao Senshu; Kenji Tokusa, both of Shizuoka, all of Japan

[73] Assignee: Hitachi, Ltd., Tokyo, Japan

[21] Appl. No.: 625,827

[22] Filed: Dec. 11, 1990

[30] Foreign Application Priority Data

Dec. 13, 1989 [JP] Japan ..... 1-321439

[51] Int. Cl.[5] ..... F25D 29/00

[52] U.S. Cl. ..... 62/56; 62/126; 62/129; 62/324.4; 62/174

[58] Field of Search ..... 62/324.4, 174, 126, 62/129

[56] References Cited

U.S. PATENT DOCUMENTS 4,612,775 9/1988 Branz et al. ..... 62/126

FOREIGN PATENT DOCUMENTS 54-63446 10/1977 Japan .
59-191571 6/1983 Japan .
62-158966 1/1986 Japan .
63-34469 7/1986 Japan .

*Primary Examiner*—John M. Sollecito
*Attorney, Agent, or Firm*—Antonelli, Terry, Stout & Kraus

[57] ABSTRACT

A heat-pump device indicates a weight of inappropriate amount of refrigerant in a heat-pump cycle by comparing an actual amount of refrigerant in the heat-pump cycle with an appropriate amount thereof, operates in accordance with a refrigerant amount judging operational mode when the actual amount of refrigerant is measured, and includes a judging device for judging the amount of refrigerant in the heat-pump cycle on the basis of a temperature of refrigerant at a condensor side and at least one information showing an operational condition of the heat-pump cycle.

15 Claims, 10 Drawing Sheets

REFRIGERATOR AND METHOD FOR INDICATING REFRIGERANT AMOUNT

BACKGROUND OF THE INVENTION

The present invention a refrigerator or an air-conditioner having a device for measuring an amount of refrigerant utilized in a refrigeration cycle and a method for indicating an amount of refrigerant in a refrigerator.

Conventional devices for measuring or judging an amount of refrigerant in a refrigeration cycle are disclosed by the publications of Japanese Utility Model Unexamined Publication No. 59-191571, of Japanese Patent Unexamined Publication No. 52-45755 and of Japanese Patent Unexamined Publication No. 54-63446.

In Japanese Utility Model Unexamined Publication No. 59-191571, a height of refrigerant liquid surface in a liquid receiver of a refrigeration cycle is measured to judge whether an amount of refrigerant is appropriate or not. In the publication of Japanese Patent Unexamined Publication No. 52-45755, a pipe line connects a suitable height position of a liquid receiver of a refrigeration cycle to an inlet side of a compressor and a sight glass and a capillary tube are arranged on the pipe line so that when a refrigerant is in a vaporized condition in the sight glass, the refrigerant is judged insufficient. In Japanese Patent Unexamined Publication No. 54-63446, it is judged whether an amount of refrigerant in a heat-pump type air conditioner is appropriate or not on the basis of pressures and temperatures at a pressure reducing device for heating and at an inlet of a compressor.

In the prior art as described above, an amount of the refrigerant can be judged to be excessive, appropriate or insufficient, but an excess or insufficient amount of the refrigerant is not calculated or indicated. Therefore, it is unclear how much the amount of the refrigerant is needed to be decreased or increased when the refrigerant is inserted into the air conditioner or the air conditioner is inspected. And an accuracy of a measured amount of refrigerant is not sufficient, because the height of refrigerant surface in the liquid receiver varies in accordance with an operating condition.

OBJECT AND SUMMARY OF THE INVENTION

The object of the present invention is to provide a method and device for determining easily and accurately an excessive or insufficient amount of refrigerant, for measuring accurately an actual amount of refrigerant and indicating the excess or insufficient amount of refrigerant without stopping the refrigeration cycle.

According to the present invention, a refrigeration device comprises a compressor, a condenser, an expansion valve and an evaporator wherein the device further comprises measuring means for measuring an amount of refrigerant in the device, comparator means for comparing the measured amount of refrigerant with an appropriate amount of refrigerant in the device and for calculating an excess or insufficient amount of refrigerant, and indicating means for indicating the calculated excess or insufficient amount of refrigerant.

According to the present invention, a method for indicating an amount of refrigerant in a refrigeration device comprises the steps of measuring an amount of refrigerant for circulating in the refrigeration device, calculating an excess or insufficient amount of refrigerant by comparing the measured amount of refrigerant with an appropriate amount of refrigerant in the refrigeration device, indicating quantitatively the calculated excess or insufficient amount of refrigerant.

According to the present invention, a refrigeration device comprises a refrigeration cycle including a compressor, a condenser, an expansion valve and an evaporator, measuring means for measuring an amount of refrigerant in the refrigeration cycle and controlling means for controlling the refrigeration cycle so that the refrigeration cycle operates in a refrigerant amount judging operational mode.

According to the present invention, a refrigeration device comprises a refrigeration cycle including a compressor, a condenser, an expansion valve and an evaporator, measuring means for measuring an amount of refrigerant in the refrigeration cycle, controlling means for controlling the refrigeration cycle so that the refrigeration cycle operates in a refrigerant amount judging operational mode when the amount of refrigerant in the refrigeration cycle is measured by the measuring means and indicating means for indicating the measured amount of refrigerant.

According to the present invention, a refrigeration device comprises measuring means for measuring an amount of refrigerant in the device, controlling means for controlling the refrigeration cycle so that the refrigeration cycle operates in a refrigerant amount judging operational mode and indicating means for indicating an excess or insufficient amount of refrigerant on the basis of the measured amount of refrigerant and a predetermined appropriate amount of refrigerant in the device.

According to the present invention, a refrigeration device comprises a refrigeration cycle including a compressor, a condenser, a refrigerant control valve and an evaporator, a thermo sensor for detecting a temperature of refrigerant at a condenser side, judging means for judging an amount of refrigerant in the refrigeration cycle on the basis of the temperature detected by the thermo sensor and at least one information showing an operational condition of the refrigeration cycle.

According to the present invention, a refrigeration device comprises a refrigeration cycle including a compressor, a condenser, a refrigerant control valve and an evaporator, judging means for judging an amount of refrigerant in the refrigeration cycle and controlling means for controlling the refrigerant control valve to set a pressure of a low pressure side of the refrigeration cycle at a constant degree.

According to the present invention, an air-conditioner comprises a refrigeration cycle including a compressor, an outdoor-side heat exchanger, an outdoor-side refrigerant control valve for controlling an amount of refrigerant supplied to the outdoor-side heat exchanger, an indoor-side heat exchanger and an indoor-side refrigerant control valve for controlling an amount of refrigerant supplied to the indoor-side heat exchanger, measuring means for measuring an amount of refrigerant in the refrigeration cycle, controlling means for controlling the refrigeration cycle so that the refrigeration cycle operates in a refrigerant amount judging operational mode when the amount of refrigerant in the refrigeration cycle is measured by the measuring means.

In the devices and methods according to the present invention, since the measured amount of refrigerant in the refrigeration cycle is compared with the appropriate amount of refrigerant in the refrigeration cycle so that the excess or insufficient amount of refrigerant is indicated, an amount of refrigerant which should be added into the refrigeration cycle or discharged therefrom is correctly determined, and an appropriate amount of refrigerant is easily added into the refrigeration cycle or discharged therefrom when the amount of refrigerant in the refrigeration cycle is adjusted.

And, since the amount of refrigerant in the refrigeration cycle is set at an appropriate degree, the performance of the refrigeration cycle is improved.

And, since the refrigeration cycle operates in the refrigerant amount judging operational mode when the amount of refrigerant in the refrigeration cycle is judged, the judgement is correctly done on the basis of the measured amount of refrigerant. And, since the refrigeration cycle operates in the refrigerant amount judging operational mode when the amount of refrigerant in the refrigeration cycle is measured, the refrigeration cycle does not need to be stopped and the amount of refrigerant in the refrigeration cycle is measured correctly.

DETAILED DESCRIPTION OF PREFERRED EMBODIMENTS

Figure 1:
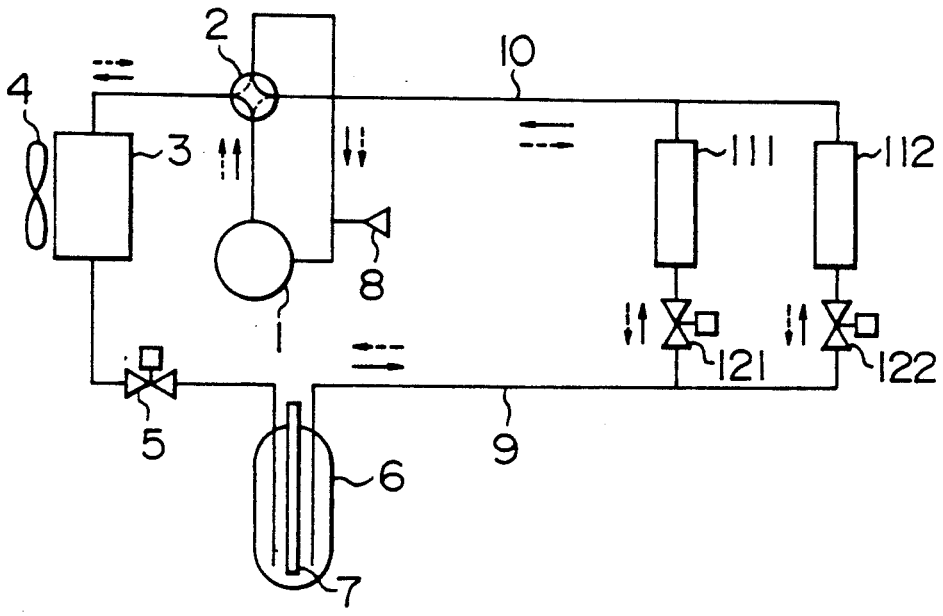
FIG. 1 is a schematic view showing an embodiment of refrigeration device according to the present invention.
Figure 2:
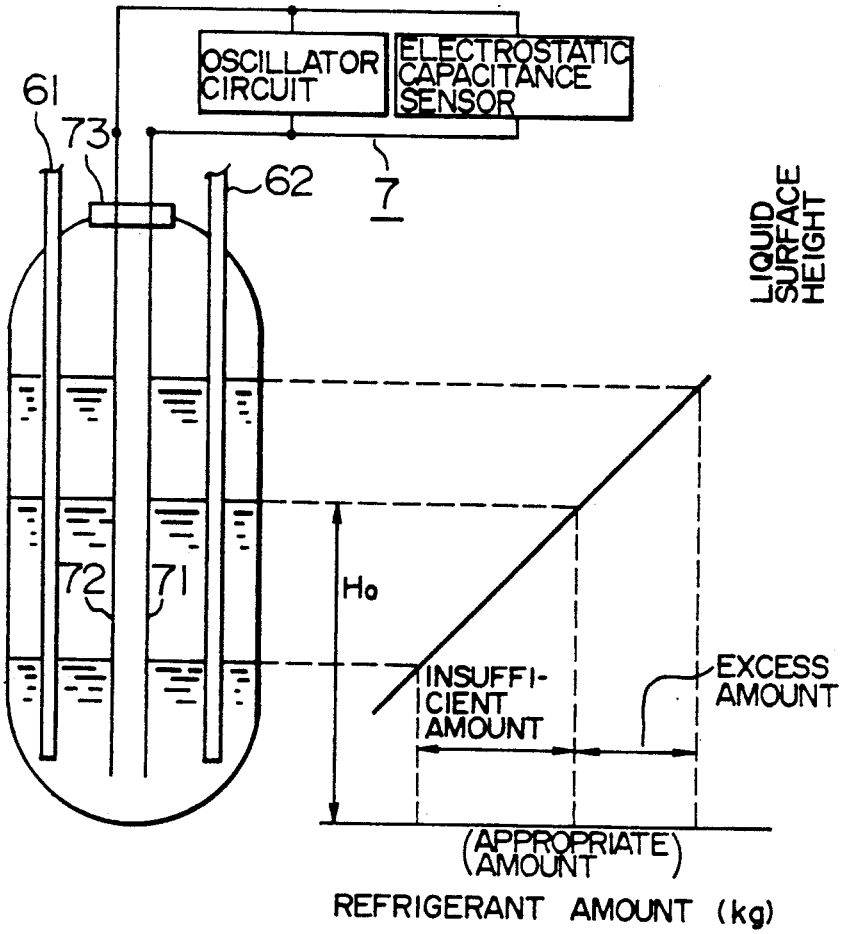
FIG. 2 is a schematic view showing a measuring device for an amount of refrigerant.
Figure 3:
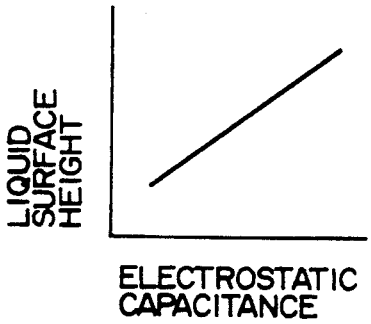
FIG. 3 is a diagram showing a principle of measuring an amount of refrigerant.

In FIG. 1, showing an air-conditioner for a plurality of air-conditioned rooms, reference numerals 1 to 8 indicate a compressor, a four way connection valve, an outdoor heat exchanger, an outdoor fan, an outdoor refrigerant control valve, a liquid receiver, a refrigerant surface sensor and a pressure sensor arranged at an inlet side of the compressor, respectively. Reference numerals 9 and 10 indicate respective connection pipes, reference numerals 111 and 112 indicate respective indoor heat exchangers, and reference numerals 121 and 122 indicate respective indoor refrigerant control valves. The refrigerant control valves 5, 121 and 122 are driven electrically to adjust flow rates of the refrigerant. In FIG. 2, showing a structure of the liquid receiver 6, reference numerals 61 and 62 indicate a flowing-in pipe and a flowing-out pipe, respectively; reference numerals 71 and 72 indicate respective electlode plates of an electrostatic capacitance sensor, and reference numeral 73 indicates an insulating member.

In a cooling operation, the refrigerant flows in a solid-line indicating direction, and the outdoor refrigerant control valve fully opens so that a pressure loss at the outdoor refrigerant control valve is very small. Therefore, a pressure of the refrigerant at the liquid receiver and the pipe 9 is high. The indoor refrigerant control valve 121 and 122 operate as expansion valves so that the air-conditioned rooms are cooled.

A height of upper surface of the liquid refrigerant in the receiver is measured by the electrostatic capacitance sensor. A capacitance between the electrode plates 71 and 72 varies in accordance with the height of upper surface of the refrigerant, since an electric conductivity of the liquid refrigerant is different from that of the vaporized refrigerant.

The height of upper surface of the liquid refrigerant in the liquid receiver 6 is determined on the basis of circumferential temperatures of the outdoor heat exchanger 3 and the indoor heat exchangers 111 and 112, and a capacity of the compressor 1 during the cooling operation. $H_0$ in FIG. 2 indicates an appropriate height of upper surface of the liquid refrigerant in the liquid receiver 6. When an actual height of upper surface of the liquid refrigerant is higher than the appropriate height $H_0$, the amount of the refrigerant is excessive, and when the actual height of upper surface of the liquid refrigerant is less than the appropriate height $H_0$, the amount of the refrigerant is insufficient. A difference between the actual height of upper surface of the liquid refrigerant and the appropriate height $H_0$ corresponds to an excess or insufficient amount of the refrigerant. Since a density of the liquid refrigerant does not vary greatly within a normal operation temperature range, a weight of the refrigerant in the liquid receiver 6 is calculated substantially accurately from a volume of refrigerant in the liquid receiver 6. If necessary for improving an accuracy of calculating the weight of the refrigerant, a temperature of the refrigerant for compensating a variation of the specific gravity of liquid refrigerant varying in accordance with temperature is measured.

Figure 4:
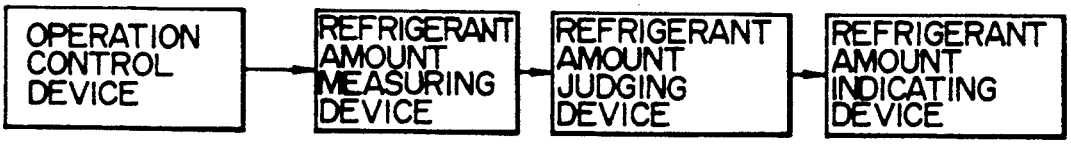
FIG. 4 is a block diagram for explaining a connection for indicating an amount of refrigerant.

As shown in FIG. 4, the refrigeration device according to the present invention has an operation control device, a refrigerant amount measuring device, a refrigerant amount judging device and a refrigerant amount indicating device. The operation control device controls the refrigeration device for a cooling operation mode or heating operation mode thereof; the refrigerant amount measuring device measures the amount of refrigerant as shown in FIG. 2; the refrigerant amount judging device compares the amount of refrigerant measured by the refrigerant amount measuring device with a predetermined appropriate amount of refrigerant to judge whether the amount of refrigerant is excessive, appropriate or insufficient and to calculate an excess or insufficient amount of refrigerant. The refrigerant amount indicating device indicates "excess", "appropriate" or "insufficient" and the calculated excess or insufficient weight of refrigerant. The calculating operation and/or the judging operation in the refrigerant amount judging device and the operation control device may be done by micro-computers. The refrigerant amount indicating device shows visible indications or sound indications.

Figure 5:
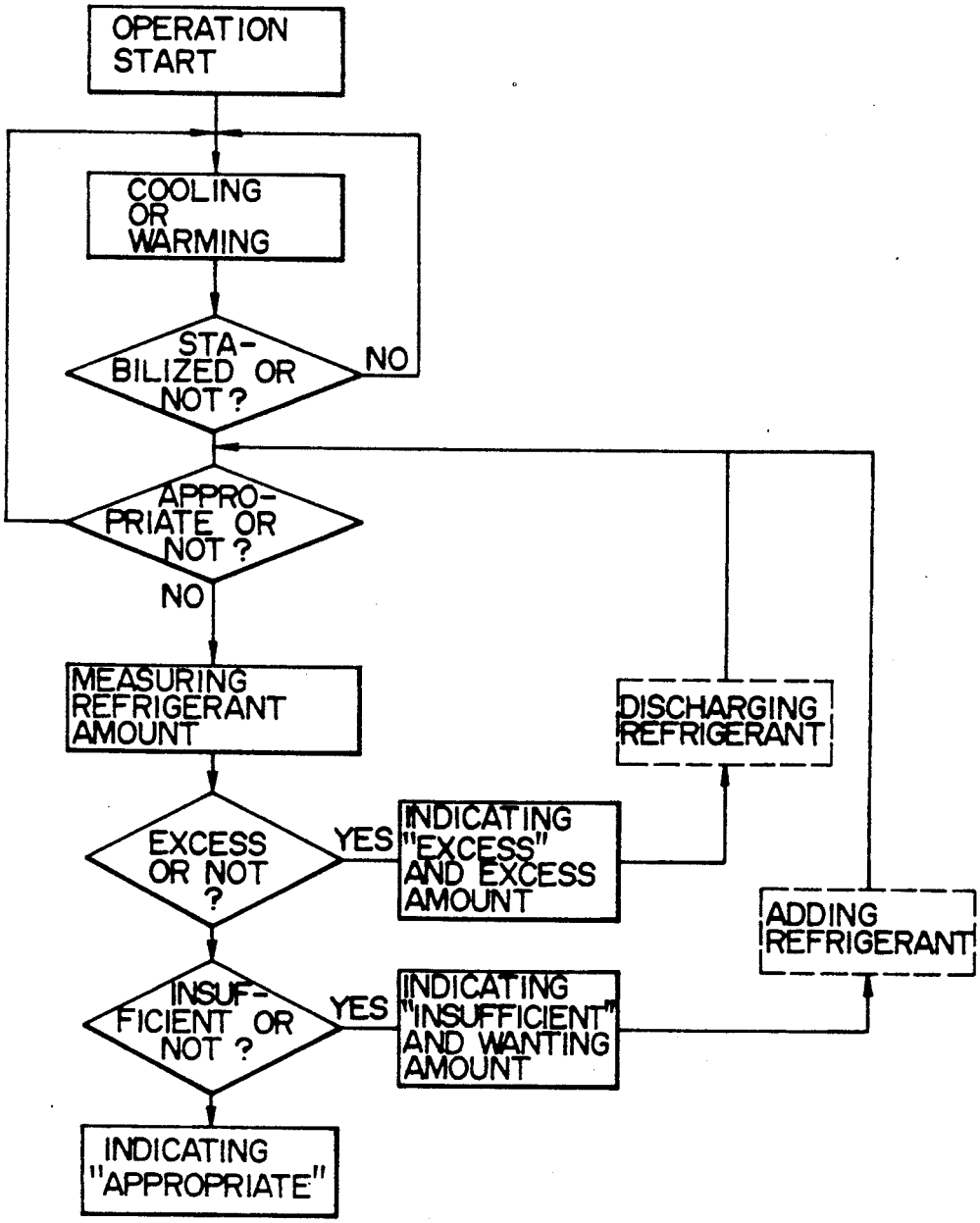
FIG. 5 is a flow chart for controlling the embodiment of refrigeration device according to the present invention.

As shown in FIG. 5, the air conditioner starts to operate after the operational mode is selected from a heating operation mode and a cooling operation mode. When an operational condition is stabilized, the amount of refrigerant is measured, it is judged whether the amount of refrigerant is excessive, appropriate or insufficient. When the amount of refrigerant is excess or insufficient, the amount of refrigerant is adjusted on the basis of the indication of the excess or insufficient amount of refrigerant. When the amount of refrigerant is appropriate, the heating or cooling operation is continued. When the pressure or temperature or amount of the refrigerant varies within a predetermined range, the operational condition of the air conditioner is judged to be stabilized. The amount of refrigerant may be measured by an ultrasonic sensor or a heat sensitizing semiconductor sensor.

Figure 6:
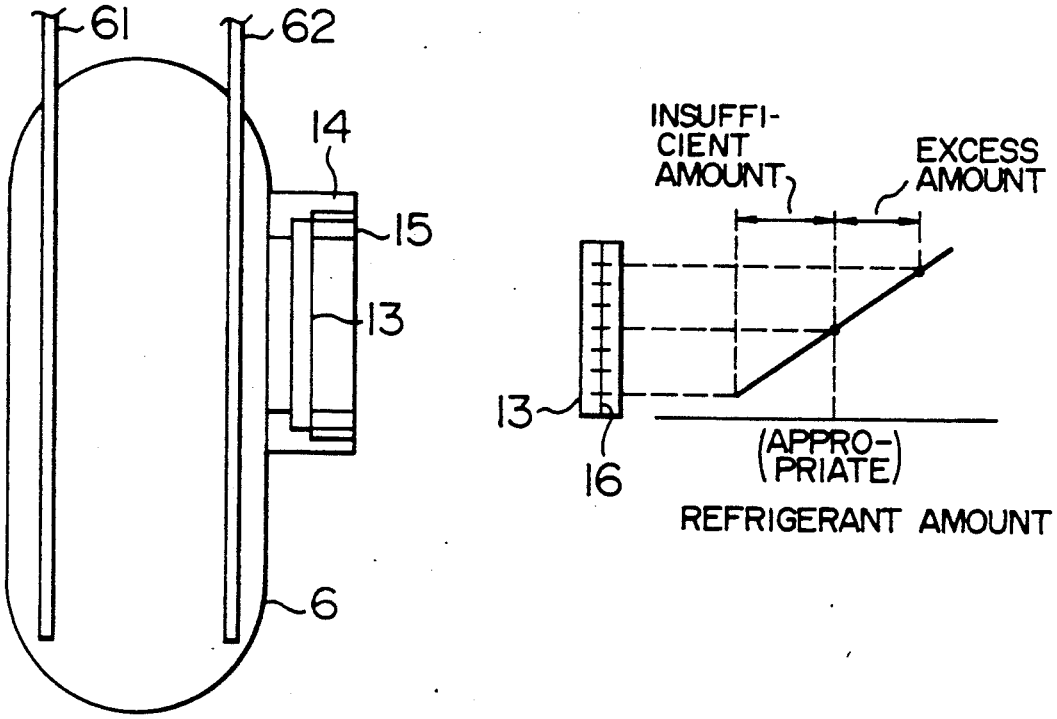
FIG. 6 is a schematic view showing another measuring device for an amount of refrigerant.

As shown in FIG. 6, the amount of refrigerant is measured through a sight glass attached to the liquid receiver. A reference numeral 13 indicates a glass; a reference numeral 14 indicates a sight glass body; a reference numeral 15 indicates a pressor for the glass 13, and a reference numeral 16 indicates a scale attached to the glass 13. In this embodiment, the amount of refrigerant is measured and visibly judged so that the excess or insufficient amount of the refrigerant is shown to easily adjust the amount of refrigerant.

In order to improve an accuracy of measuring the amount of refrigerant, it is necessary to stabilize the operational condition of the refrigeration cycle. Circumferential temperatures of the condenser and the evaporator need to be stabilized. But, it is difficult to stabilize the circumferential temperatures of the condenser and the evaporator in an actual operational condition, and a long time is necessary to stabilize the operational condition of the refrigeration cycle. In the present invention, the refrigeration cycle is operated in a refrigerant amount judging operational mode for improving the accuracy of measuring the amount of refrigerant and for decreasing a time needed to judge the amount of refrigerant.

Figure 7:
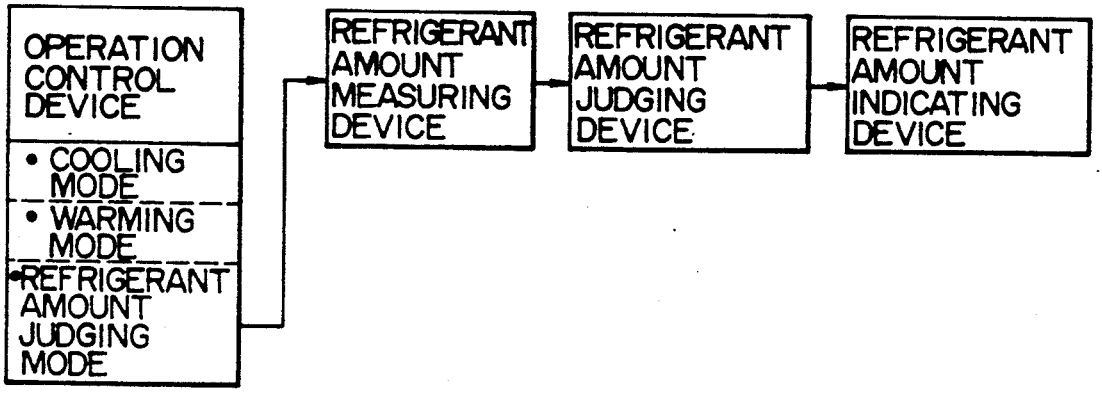
FIG. 7 is a block diagram for explaining the refrigerant amount judging operational mode.

As shown in FIG. 7, when the refrigerant amount judging operational mode is selected by the operational control device, opening degrees of the indoor refrigerant control valves 121 and 122 are set at a predetermined very small degree as expansion valves. Since flow rates of the refrigerant at the indoor heat exchangers 111 and 112 are set at a predetermined very small degree, the refrigerant vaporizes completely at the indoor heat exchangers 111 and 112 and the liquid of the refrigerant does not exist between the indoor refrigerant control valves 121 and 122 and the inlet of the compressor 1. Since a density of vapor of the refrigerant is very small, the amount of vapor of the refrigerant does not greatly vary in accordance with the circumferential temperature of the indoor heat exchangers 111 and 112 and is significantly smaller than that of the liquid of the refrigerant, the amount of refrigerant existing between the indoor refrigerant control valves 121 and 122 and the inlet of the compressor 1 is small, and most of the amount of refrigerant exists between the indoor refrigerant control valves 121 and 122 and the outlet of the compressor 1. Instead of setting the opening degrees of the indoor refrigerant control valves 121 and 122 at the predetermined very small degree, a pressure between the indoor refrigerant control valves 121 and 122 and the inlet of the compressor 1 may be set at a predetermined very small degree by the indoor refrigerant control valves 121 and 122 with a feed-back of a pressure sensor 8, for example, at 0 to 1 $kg/cm^2g$ (when the refrigerant is R22) to vaporize substantially completely the refrigerant between the indoor refrigerant control valves 121 and 122 and the inlet of the compressor 1. If an output of the compressor 1 is variable, the output may be fixed at a certain degree during the refrigerant amount judging operational mode. In the refrigerant amount judging operational mode, a flow rate at the evaporators 111 and 112 is preferably maintained smaller than a normal flow rate at the evaporators 111 and 112 during a normal cooling or heating operation of the refrigeration cycle, or kept at a minimum flow rate at the evaporators 111 and 112 during the normal cooling or heating operation thereof. In the refrigerant amount judging operational mode, it is necessary at least to keep the flow rate at the evaporators and or at the expansion valve less than a predetermined degree or at a predetermined constant degree. In order to keep the flow rate in the refrigeration device less than or equal to a desired or predetermined flow rate in the refrigerant amount judging operational mode, the refrigerant control valves 121 and 122 and/or the refrigerant control valve 5 are suitably driven. In order to keep the flow rate in the refrigeration device less than or equal to the desired or predetermined flow rate in the refrigerant amount judging operational mode, another valve device (not shown) may be arranged between the outlet of the condenser and the inlet of the compressor. In the present invention, the amount of refrigerant is measured on the basis of a condition of refrigerant at a range which extends between the compressor and the expansion valve and which includes the condenser and does not include the evaporator, and/or the flow rate at another range which extends between the compressor and the expansion valve and which includes the evaporator and does not include the condenser is made less than or equal to the desired or predetermined flow rate in the refrigerant amount judging operational mode. The amount of refrigerant is estimated on the basis of the condition of refrigerant at the range which extends between the compressor and the expansion valve and which includes the condenser and does not include the evaporator, that is, is directly measured from an upper surface of the liquefied refrigerant or is estimated on the basis of a pressure or subcooling degree of the refrigerant at this range and a circumferential temperature of the condenser, or is calculated from an electrical input current of compressor which is substantially in proportion to the pressure of the refrigerant at this range or from a rotational speed of compressor which is substantially in proportion to the amount of refrigerant at this range when the pressure at this range is kept at a constant degree. That is, in the present invention, the amount of refrigerant is judged or measured on the basis of the condition of the refrigerant at the range which extends between the compressor and the expansion valve and which includes the condenser and does not include the evaporator, so that an accuracy for judging or measuring the amount of refrigerant is improved. Generally, in the normal operation of the refrigeration cycle, about 10 to 20 percent of an entire refrigerant amount in the refrigeration cycle exist in another range which extends between the compressor and the expansion valve and which includes the evaporator and does not include the condenser. Therefore, in the refrigerant amount judging operational mode, a rate of the refrigerant amount existing in another range which extends between the compressor and the expansion valve and which includes the evaporator and which does not include the condenser to the entire refrigerant amount in the refrigeration cycle is preferably kept less than 10 percent. Or, generally, in the normal operation of the refrigeration cycle, a degree of superheat of the vapor refrigerant between the evaporator and the inlet of the compressor is 0 to 10 degrees. If, in the refrigerant amount judging operational mode, the degree of superheat of the vapor refrigerant between the evaporator and the inlet of the compressor is kept more than 10 degrees, the amount of refrigerant existing in the another range which extends between the compressor and the expansion valve and which includes the evaporator and does not include the condenser is kept very small.

When the refrigerant amount judging operational mode is selected during the heating operation, the refrigerant flows in a direction shown by a broken line in FIG. 1, and an opening degree of the outdoor refrigerant valve 5 is set very small as an expansion valve or a pressure between the outdoor refrigerant control valve 5; and the inlet of the compressor 1 may be set very small. When the refrigerant amount judging operational mode is selected during the cooling operation, the refrigerant flows in a direction shown by a solid line in FIG. 1 and opening degrees of the indoor refrigerant control valves 121 and 122 are set very small as expansion valves or the pressure between the indoor refrigerant control valves 121 and 122, and the inlet of the compressor 1 may be set very small. Therefore, in the refrigerant amount judging operational mode, the refrigerant between the expansion valve(s) and the inlet of the compressor is substantially completely vaporized.

Figure 8:
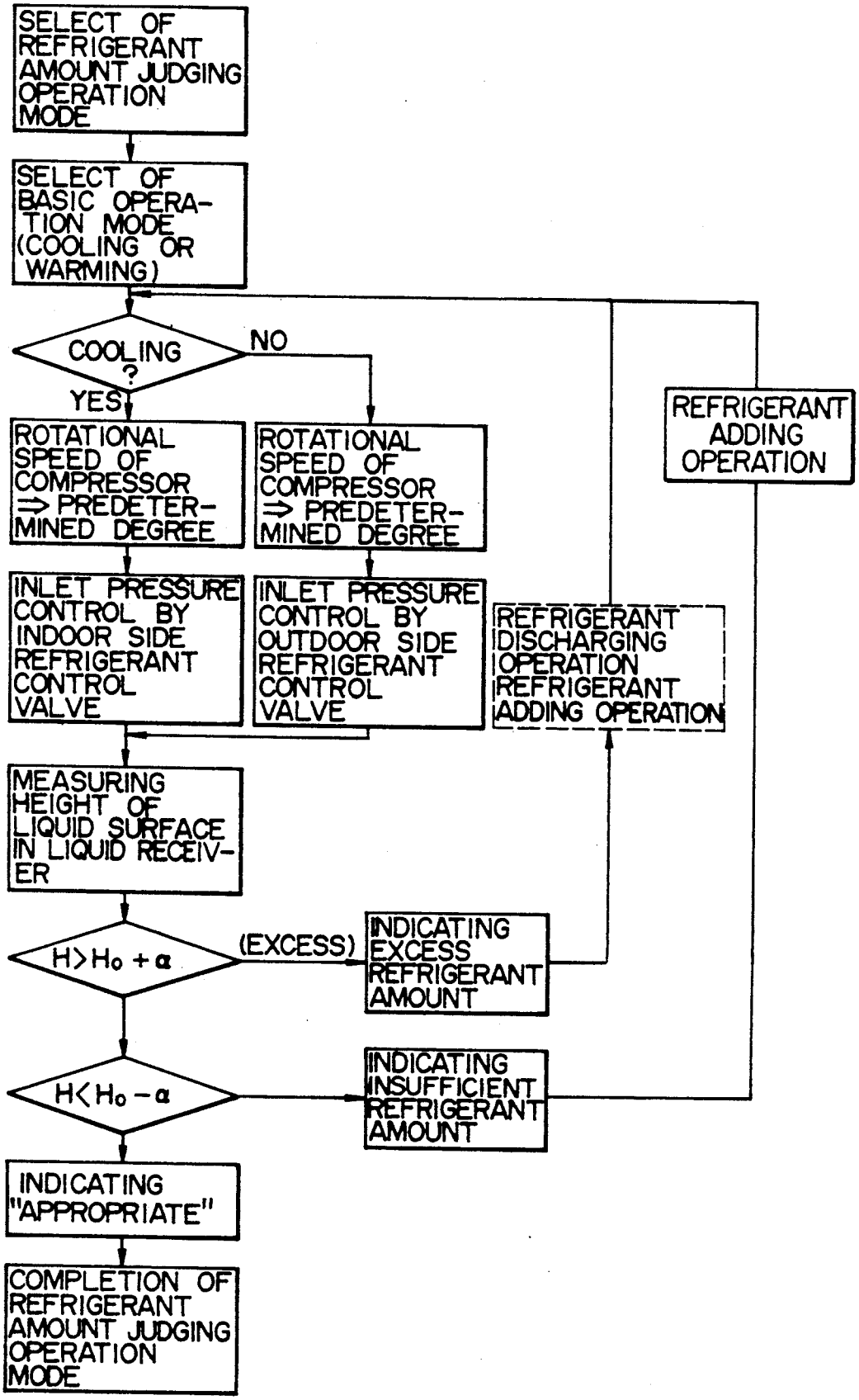
FIG. 8 is a flow chart for controlling the connection shown in FIG. 7.

As shown in FIG. 8, when the refrigerant amount judging operational mode is selected during the cooling operation, the output or rotational speed of the compressor 1 is fixed at a predetermined degree, and the indoor refrigerant control valves 121 and 122 control the pressure between the indoor refrigerant control valves 121 and 122 and the inlet of the compressor 1. After the condition of the refrigeration cycle is stabilized, the amount of refrigerant is measured and judged. The measuring and judging operations in this case are similar to those shown in FIG. 5. When the amount of refrigerant is at an appropriate predetermined degree, the refrigerant amount judging operational mode is finished. If the refrigerant amount judging operational mode is finished when the amount of refrigerant is within an appropriate predetermined range, a time needed for the refrigerant amount judging operational mode may be small. If the amount of refrigerant is compensated in accordance with the circumferential temperature of the condensor when the amount of refrigerant is judged, an accuracy of judging the amount of refrigerant is improved.

Figure 9:
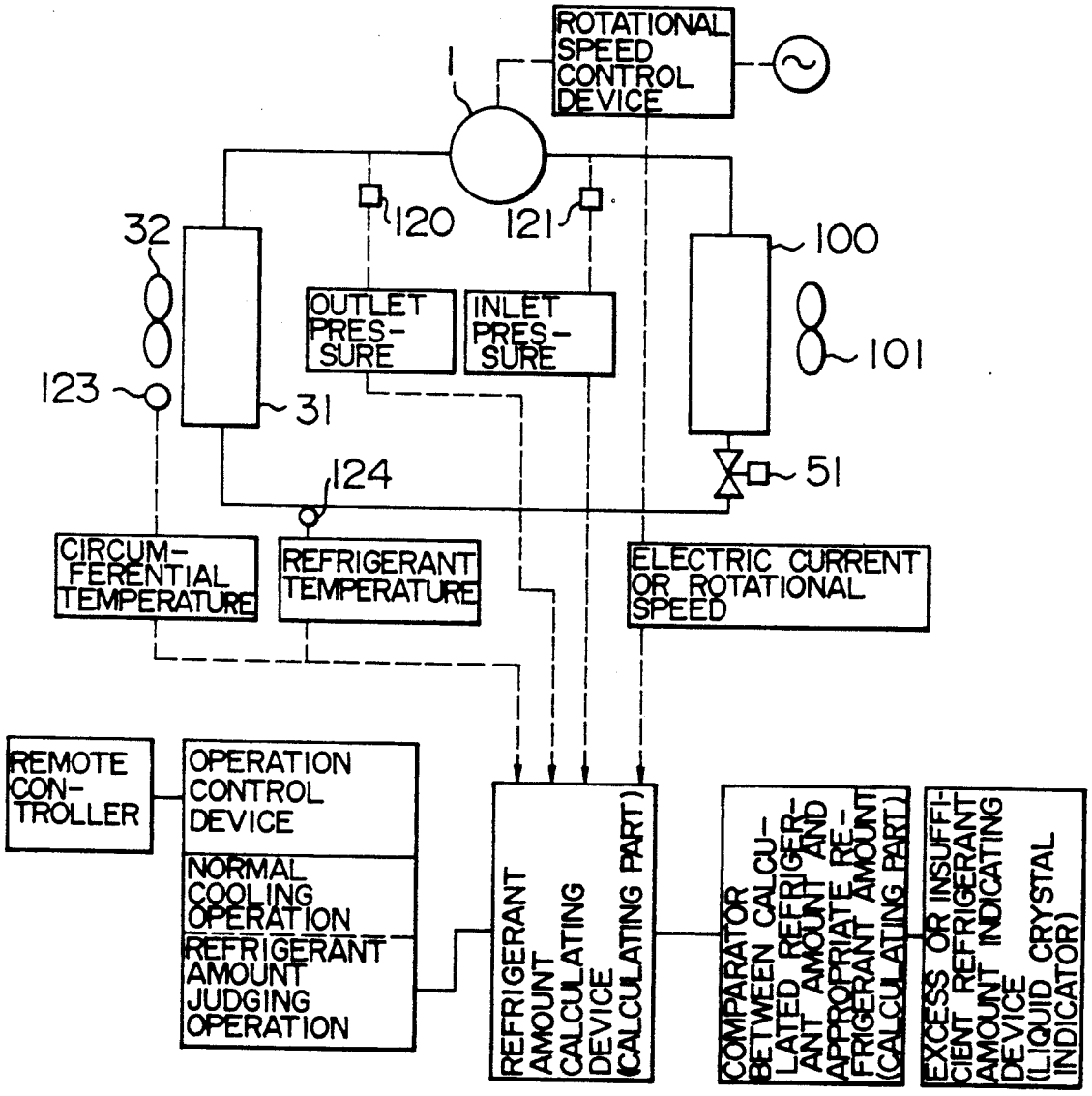
FIG. 9 is a schematic view showing another embodiment of refrigeration device according to the present invention.

In another embodiment shown in FIG. 9, reference numerals 1, 31, 32, 51, 100, 101 indicating a compressor, a condenser, a condenser fan, an electrically driven refrigerant control valve, an evaporator and an evaporator fan, respectively, and these form a refrigeration cycle. Reference numerals 120, 121 and 123 indicate a pressure sensor for measuring a pressure at an outlet of the compressor 1, a pressure sensor for measuring a pressure at an inlet of the compressor 1 and a temperature sensor for measuring a circumferential temperature of the condensor 31. The compressor 1 is a rotational speed variable compressor controlled by a rotational speed control device. The compressor 1, the condenser fan 32 and the evaporator fan 101 are controlled by an operation control device. The operation control device controls the refrigeration cycle to operate in the refrigerant amount judging operational mode or in a normal cooling operational mode. In the refrigerant amount judging operational mode, a refrigerant amount calculating device, a refrigerant amount comparing device and a refrigerant amount indicating device for indicating "excess state" of "insufficient state" of the refrigerant and/or indicating quantitatively the excess or insufficient weight of refrigerant are operated. Outputs of the sensors 120, 121 and 123 are input into the refrigerant amount calculating device. Outputs of the rotational speed control device, that is, an electric current or a rotational speed instructing signal are input into the refrigerant amount calculating device. The refrigerant amount calculating device and the refrigerant amount comparing device may be micro-computers with respective calculating programs. The refrigerant amount indicating device may include a liquid crystal type indicator attached to a remote controller.

Figure 10:
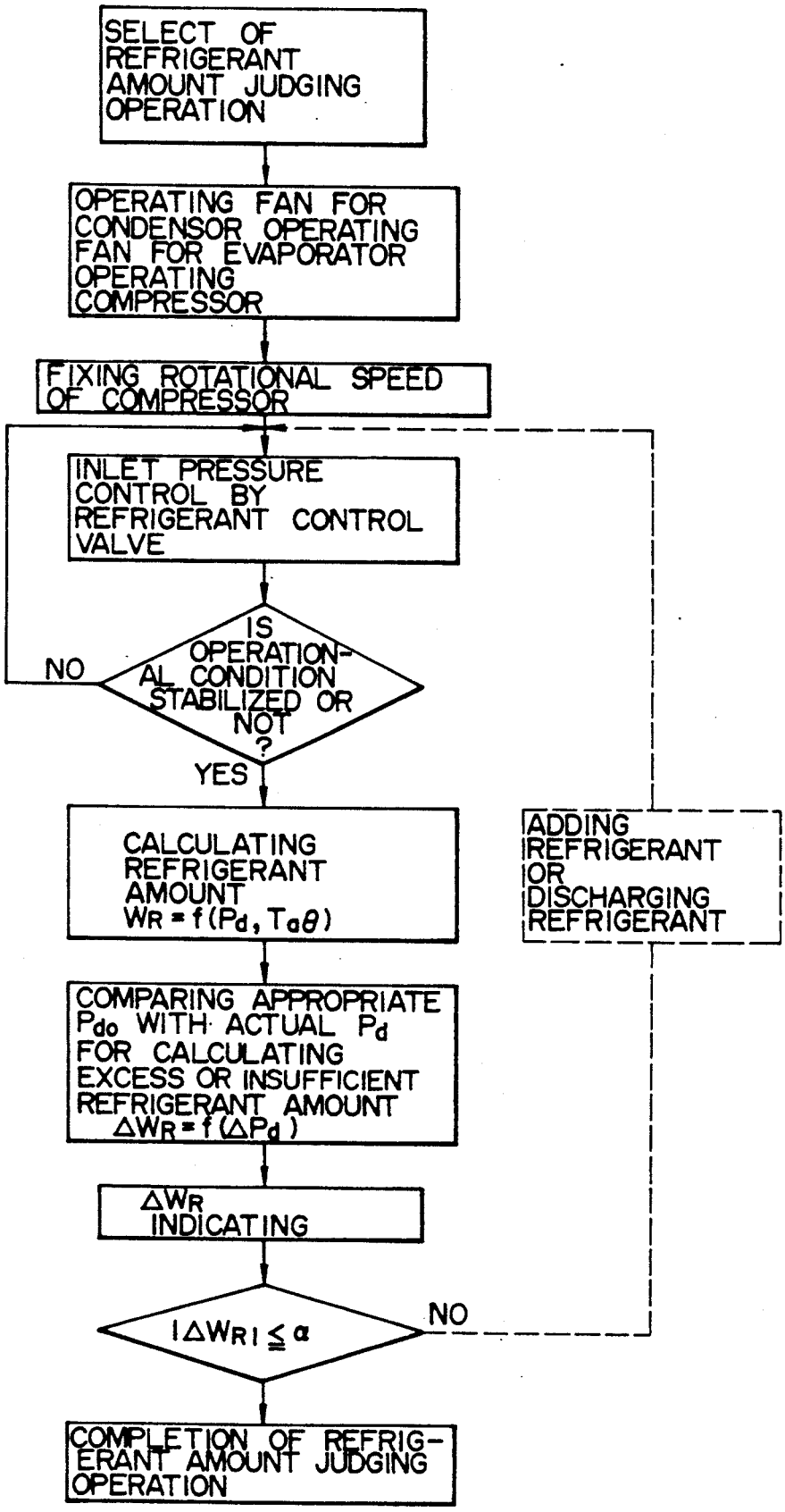
FIG. 10 is a flow chart for controlling the embodiment of FIG. 9.
Figure 11:
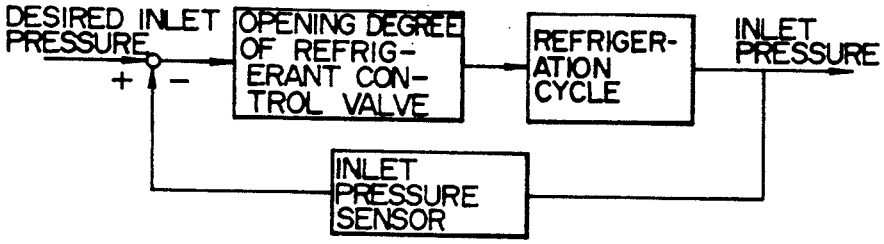
FIG. 11 is a block diagram showing a connection for controlling an inlet pressure by a refrigerant control valve.

As shown in FIG. 10, when the refrigerant amount judging operational mode is selected, the fans 32 and 101 and the compressor 1 operate; the rotational speed of the compressor 1 is fixed at a predetermined degree, and the pressure between the refrigerant control valve 51 and the inlet of the compressor 1 is set at a predetermined constant inlet pressure Ps by the refrigerant control valve 51. As shown in FIG. 11, the refrigerant control valve 51 increases an opening degree thereof when an actual pressure measured by the inlet pressure sensor 121 between the refrigerant control valve 51 and the inlet of the compressor 1 is less than the predetermined constant inlet pressure Ps, and decreases the opening degree thereof when an actual pressure between the refrigerant control valve 51 and the inlet of the compressor 1 is more than the predetermined constant inlet pressure Ps. The predetermined constant inlet pressure Ps is significantly less than an inlet pressure during a normal cooling operation so that a flow rate of refrigerant into the evaporator 100 is very small, and the refrigerant is substantially completely vaporized in the evaporator 100. That is, since the pressure between the refrigerant control valve 51 and the inlet of the compressor 1 is set small, the refrigerant is substantially completely vaporized therebetween. Since the specific gravity of the vapor of refrigerant does not vary largely in accordance with a variation of temperature thereof, the amount of refrigerant or a rate of the amount of refrigerant between the refrigerant control valve 51 and the inlet of the compressor 1 to the amount of refrigerant between the refrigerant control valve 51 and the outlet of the compressor 1 does not greatly vary even if the circumferential temperature of the evaporator 100 varies. Therefore, most of the amount of refrigerant exists between the refrigerant control valve 51 and the outlet of the compressor 1, particularly in the condensor 31.

Figure 12:
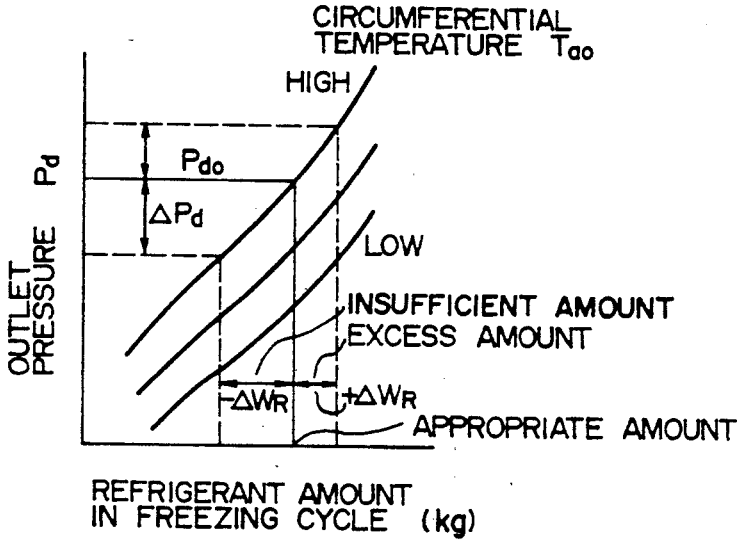
FIGS. 12 to 14 are diagrams for calculating the amount of refrigerant.

When the amount of refrigerant and the excess or insufficient amount of refrigerant are calculated after the operational condition of the refrigeration cycle is stabilized, a diagram shown in FIG. 12 is utilized. FIG. 12 shows a relationship between an outlet pressure Pd of the compressor 1 and the amount of refrigerant Wr in the refrigeration cycle on each of circumferential temperatures Tao. The larger the amount of refrigerant Wr, the larger the outlet pressure Pd of the compressor 1, or the higher the circumferential temperature of the condenser 31, because an efficiency for cooling or liquefying the refrigerant in the condenser 31 decreases when the amount of refrigerant increases in the condenser 31 and/or the circumferential temperature of the condenser 31 is high so that the pressure in the condenser is not greatly decreased by liquefying the refrigerant. Therefore, the amount of refrigerant is calculated on the basis of the measured circumferential temperature of the condensor 1 and the measured outlet pressure Pd of the compressor 1. Since the inlet pressure of the compressor 1 is set at the predetermined pressure, the accuracy of calculating the amount of refrigerant is improved. An appropriate outlet pressure Pdo can be calculated on the basis of an actual circumferential temperature of the condensor 1 and a desired amount of refrigerant. The excess or insufficient amount of refrigerant is calculated from a difference between the appropriate pressure Pdo calculated above and the actual pressure measured by the outlet pressure sensor 120. The calculated excess or insufficient amount of refrigerant is indicated by the indicating device as shown in FIG. 10. If the excess or insufficient amount of refrigerant is within an appropriate predetermined range, the refrigerant amount judging operational mode is finished. If the excess or insufficient amount of refrigerant is not within an appropriate predetermined range, the refrigerant is charged in the refrigerating cycle or discharged therefrom to make the amount of refrigerant at the appropriate or desired degree.

Figure 13:
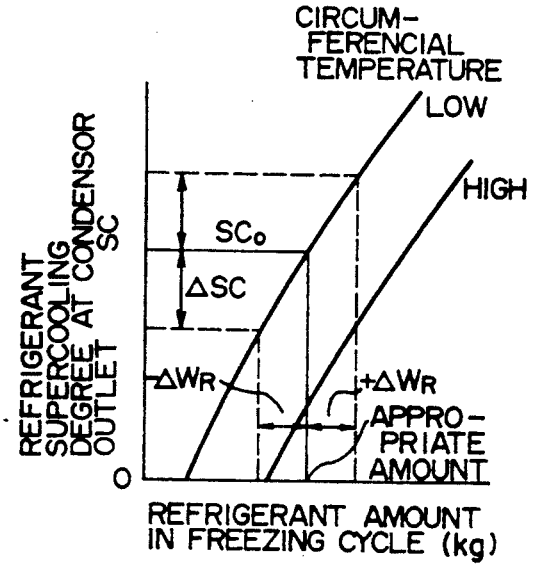

FIG. 13 shows the relationship between the circumferential temperature, the amount of refrigerant in the refrigeration cycle and a refrigerant subcooling degree Sc at an outlet of the condensor. The refrigerant subcooling degree Sc is a difference between the temperature measured by a refrigerant temperature sensor 124 at the outlet of the condensor 31 and a refrigerant saturation temperature determined by the pressure at the outlet of the compressor 1. Since the liquid refrigerant remains for a long time in the condenser 31 or a time between liquefying of the refrigerant and flowing-out thereof from the condensor 31 is large so that the liquid refrigerant is cooled sufficiently when the amount of the refrigerant is large and a large part of the condenser 31 is filled by the liquid refrigerant, the larger the amount of refrigerant, the larger the refrigerant subcooling degree Sc, so that the amount of refrigerant can be calculated from the refrigerant subcooling degree Sc. If the refrigerant subcooling degree Sc is zero, the refrigerant must be supplied to the refrigeration cycle.

Figure 14:
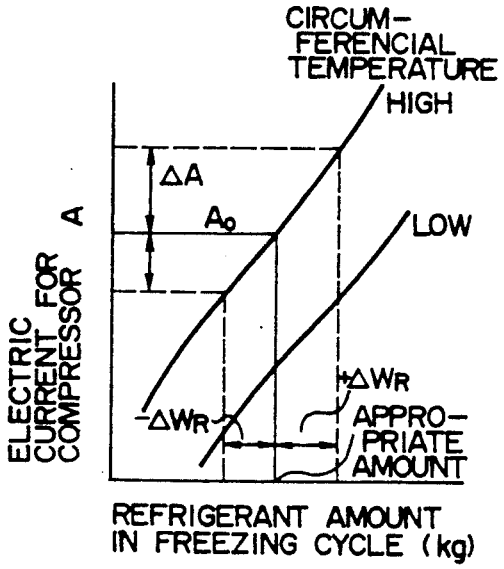

FIG. 14 shows the relationship between the circumferential temperature, the amount of refrigerant in the refrigeration cycle and an electric current supplied to the compressor 1. Since the pressure at the outlet of the compressor 1 is substantially proportional to the amount of refrigerant as shown in FIG. 12, and the electric current supplied to the compressor 1 is substantially proportional to the pressure at the outlet of the compressor 1 when the pressure at the inlet of the compressor 1 is kept constant, the amount of refrigerant can be calculated on the basis of the circumferential temperature and the electric current supplied to the compressor 1. As described above, the amount of refrigerant can be calculated from the circumferential temperature of the condenser 31 and one of the pressure at the outlet of the compressor 1, the refrigerant supercooling degree Sc and the electric current supplied to the compressor 1.

Figure 15:
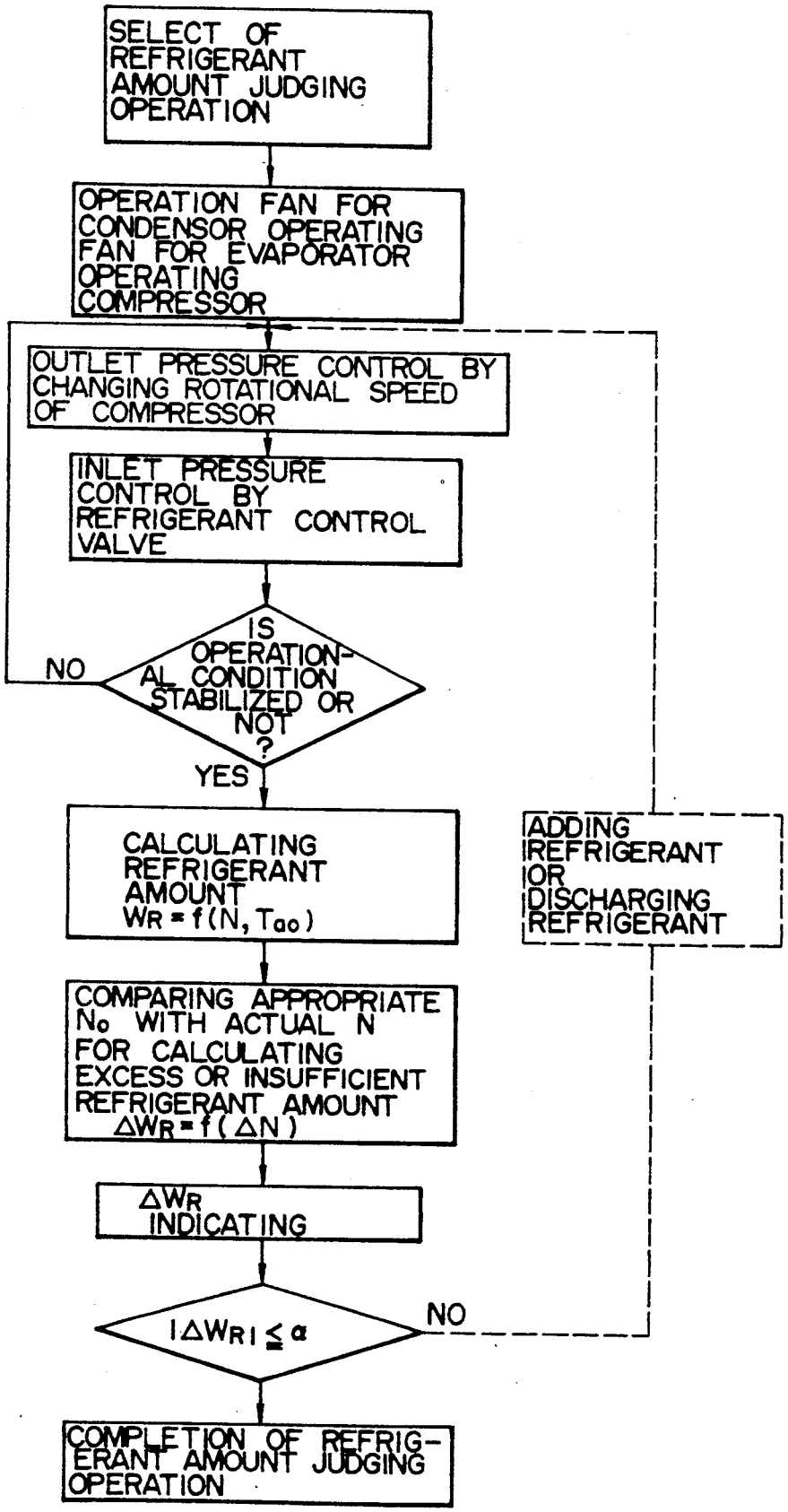
FIG. 15 is another flow chart for controlling the embodiment of the present invention.
Figure 16:
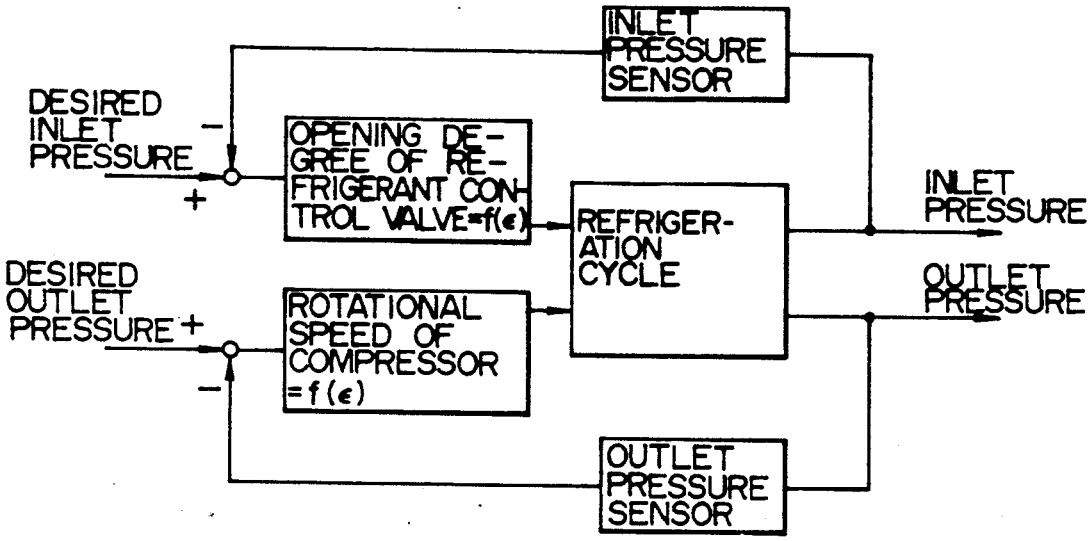
FIG. 16 is a block diagram showing a connection for controlling an inlet pressure and outlet pressure.
Figure 17:
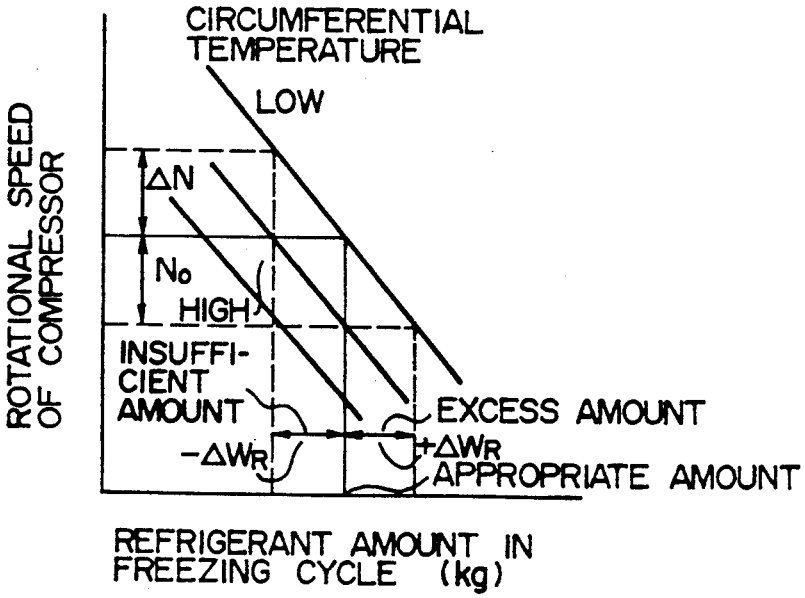
FIG. 17 is a diagram for calculating the amount of refrigerant.

As shown in FIG. 15, the pressure at the outlet-side of the compressor 1 may be kept at a constant predetermined degree by controlling the rotational speed of the compressor 1, and the pressure at the inlet-side of the compressor 1 may be kept at a constant predetermined degree by controlling the refrigerant control valve 51, in the refrigerant amount judging operational mode. As shown in FIG. 16, the pressure at the inlet-side of the compressor 1 is controlled by the refrigerant control valve 51 with a feed-back control through an inlet pressure sensor, and the pressure at the outlet-side of the compressor 1 is controlled by the compressor 1 with a feed-back control through an outlet pressure sensor. In order to keep the outlet-side of the compressor 1 at the constant predetermined degree, when the amount of refrigerant is large to make the pressure at the outlet-side of the compressor 1 high, the rotational speed of the compressor 1 is decreased, and when the amount of refrigerant is small to make the pressure at the outlet-side of the compressor 1 low, the rotational speed of the compressor 1 is increased. Therefore, the amount of refrigerant is substantially related to the rotational speed of the compressor 1. FIG. 17 shows the relationship between the rotational speed of the compressor 1, keeping the outlet pressure constant, the amount of refrigerant and the circumferential temperature of the condenser. In order to keep the outlet-side of the compressor 1 at the constant predetermined degree, the electric input current of the compressor 1 may be controlled.

Figure 18:
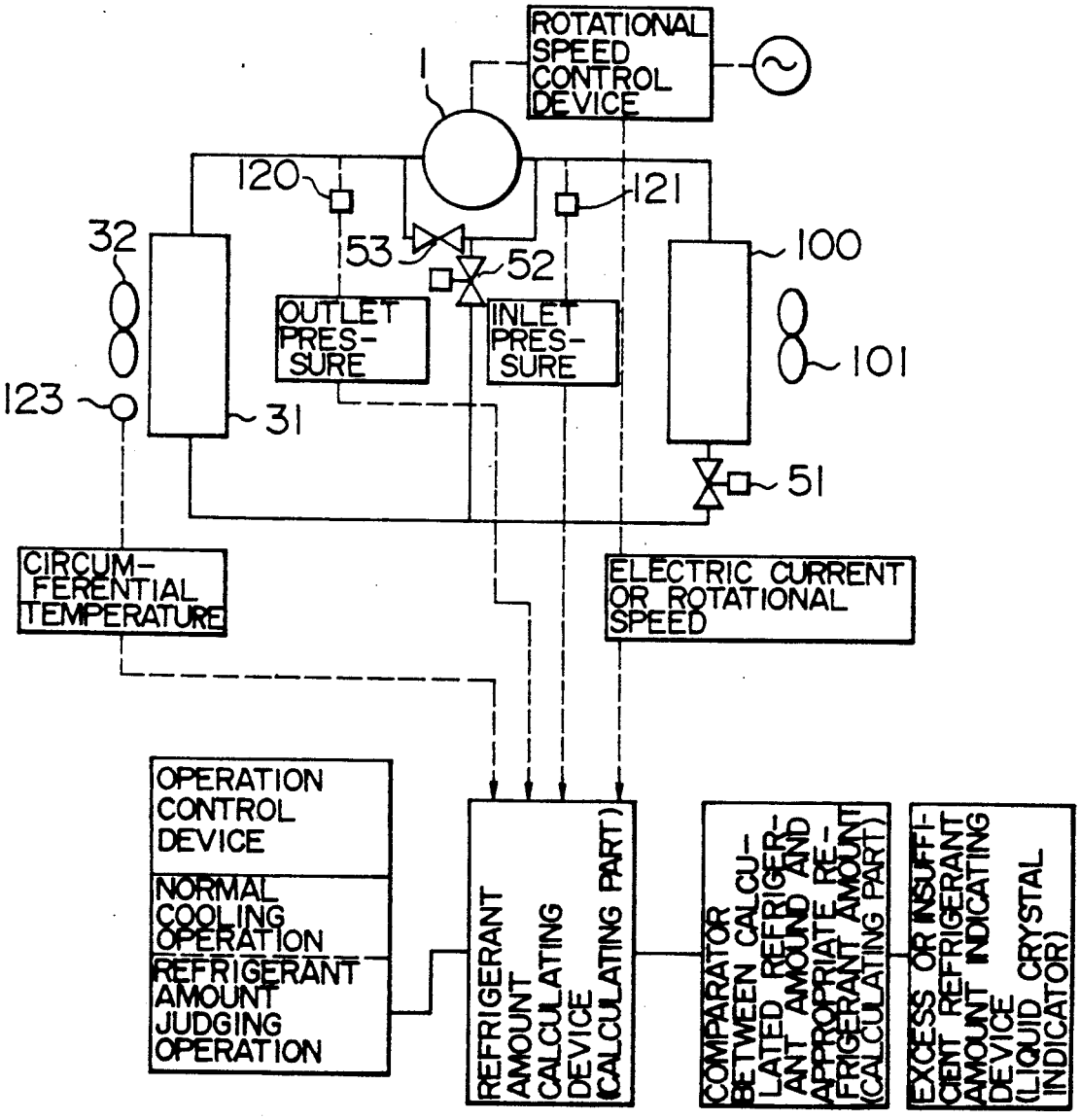
FIG. 18 is a schematic view showing the other embodiment of refrigeration device according to the present invention.

As shown in FIG. 18, a bypass pipe including a valve 53 may be arranged between the inlet and outlet sides of the compressor 1, and a bypass pipe including a valve 52 may be arranged between the inlet of the compressor 1 and a pipe line between the condenser 31 and the expansion valve 51. In the refrigerant amount judging operational mode of this embodiment, the valve 53 is opened slightly to allow the refrigerant to flow from the outlet-side to the inlet-side, and the valve 52 is opened in accordance with a temperature of the inlet-side or outlet-side of the compressor 1, so that an excess amount of liquid of the refrigerant is prevented from flowing into the inlet of the compressor 1 and an overload of the compressor 1 is prevented. Since the refrigerant from valve 53 flows into the inlet of the compressor 1, the valve 51 does not need to open largely. Therefore, a flow rate or remaining amount of the refrigerant at the evaporator 100 may be smaller in comparison with the above embodiments, and the accuracy for measuring the amount of refrigerant is not deteriorated by a variation of circumferential temperature of the evaporator 100. The relationship shown in FIGS. 12 to 14 and 17 are also used to calculate the amount of refrigerant in this embodiment.

What is claimed is:

1. A heat-pump device including a heat-pump cycle comprising a compressor, a condenser, an expansion valve and an evaporator, wherein the heat-pump device further includes measuring means for measuring an actual amount of refrigerant in the heat-pump cycle, calculating means for calculating quantitavely an insufficient amount of refrigerant in the heat-pump cycle by comparing the actual amount of refrigerant measured by the measuring means with an appropriate amount of refrigerant in the heat-pump cycle, and indicating means for indicating quantitatively the insufficient amount of refrigerant calculated by the calculating means.

2. A heat-pump device according to claim 1, wherein the indicating means indicates the actual amount of refrigerant measured by the measuring means.

3. A method for indicating an amount of refrigerant, comprising:

measuring an actual amount of the refrigerant circulating in a heat-pump cycle;

calculating quantitatively an insufficient amount of the refrigerant in the heat-pump cycle by comparing the actual amount of refrigerant in the heat-pump cycle; and indicating quantatively the insufficient amount of refrigerant calculated in the calculating step.

4. A heat-pump device including a heat-pump cycle comprising a compressor, a condenser, an expansion valve and an evaporator, wherein the heat-pump device further includes measuring means for measuring an actual amount of refrigerant in the heat-pump cycle, and control means for controlling the heat-pump cycle so that the heat-pump cycle operates in accordance with a refrigerant amount judging operational mode when an amount of refrigerant in the heat-pump cycle is measured by the measuring means.

5. A heat-pump device according to claim 4, wherein the device further comprises indicating means for indicating the actual amount of refrigerant measured by the measuring means.

6. A heat-pump device according to claim 4, wherein the measuring means detects a surface of the liquid refrigerant in a liquid receiver arranged between the condensor and the evaporator.

7. A heat-pump device according to claim 6, wherein the measuring means is an electrostatic capacitance sensor.

8. A heat-pump device according to claim 6, wherein the measuring means include a sight glass attached to the liquid receiver, and the sight glass includes a scale for judging a height of the liquid surface to detect the amount of refrigerant.

9. A heat-pump device according to claim 6, wherein the control means correct a relation between a height of the surface of the liquid refrigerant in the liquid receiver and the actual amount of refrigerant in the heat-pump cycle in accordance with a load condition of the condenser.

10. A heat-pump device including a heat-pump cycle comprising a compressor, a condenser, an expansion valve and an evaporator, wherein the heat-pump device further includes measuring means for measuring an actual amount of refrigerant in the heat-pump cycle, control means for controlling the heat-pump cycle so that the heat-pump cycle operates in accordance with a refrigerant amount judging operational mode when the actual amount of refrigerant in the heat-pump cycle is measured by the measuring means, and indicating means for indicating an insufficient amount of refrigerant in the heat-pump cycle by comparing the actual amount of refrigerant measured by the calculating means with an appropriate amount of the refrigerant in the heat-pump cycle.

11. A heat-pump device according to claim 10, wherein the indicating means indicates a weight of the insufficient amount of refrigerant in the heat-pump cycle.

12. A heat-pump device including a heat-pump cycle comprising a compressor, a condenser, an expansion valve and an evaporator, wherein the heat-pump device further includes refrigerant amount judging means for judging an amount of refrigerant in the heat-pump cycle, and pressure control means for controlling the expansion valve to keep a pressure of a low pressure side of the heat-pump cycle at a constant degree when the amount of refrigerant in the heat-pump cycle is judged by the refrigerant amount judging means.

13. A heat-pump device including a heat-pump cycle comprising a compressor, a condenser, an evaporator and an evaporator flow rate control valve for controlling a flow rate of refrigerant at the evaporator, measuring means for measuring an actual amount of refrigerant in the heat-pump cycle, and control means for controlling the heat-pump cycle so that the heat-pump cycle operates in accordance with a refrigerant amount judging operational mode when the actual amount of refrigerant in the heat-pump cycle is measured by the measuring means.

14. A heat-pump device according to claim 13, wherein, in the refrigerant amount judging operational mode, the control means control the evaporator flow rate control valve so that the flow rate of refrigerant at the evaporator is kept less than a predetermined degree.

15. A heat-pump device according to claim 13, wherein the heat-pump device further comprises pressure measuring means for measuring a pressure of a low pressure side of the heat-pump cycle, in the refrigerant amount judging operational mode, the pressure of the low pressure side of the heat-pump cycle is maintained low by the evaporator flow rate control valve.

* * * * *